US005595381A

United States Patent [19]

Schickedanz

[11] Patent Number: 5,595,381

[45] Date of Patent: Jan. 21, 1997

[54] SHEET FEEDER UNIT

[75] Inventor: Karl-Heinz Schickedanz, Neu-Isenburg, Germany

[73] Assignee: MAN Roland Druckmaschinen AG, Germany

[21] Appl. No.: 307,196

[22] Filed: Sep. 16, 1994

[30] Foreign Application Priority Data

Sep. 17, 1993 [DE] Germany ..... 43 31 610.7

[51] Int. Cl.[6] ..... B65H 5/08

[52] U.S. Cl. ..... 271/12; 271/270

[58] Field of Search ..... 271/12, 10.03, 271/90, 107, 270, 202, 203

[56] References Cited

U.S. PATENT DOCUMENTS

| | | | |
|---|---|---|---|
| 2,661,948 | 12/1953 | Montgomery | 271/12 |
| 2,756,049 | 7/1956 | Stolz | 271/12 |
| 3,861,672 | 1/1975 | Norton | 271/203 |
| 4,189,136 | 2/1980 | Robinette | 271/12 |
| 5,112,038 | 5/1992 | Dunaway | 271/10.03 |
| 5,295,677 | 3/1994 | Hutner | 271/10.03 |

FOREIGN PATENT DOCUMENTS

| | | | |
|---|---|---|---|
| 3544359C1 | 5/1987 | Germany . | |
| 4140051A1 | 6/1993 | Germany . | |
| 48806 | 6/1988 | Japan | 271/203 |
| 49109 | 9/1991 | Japan | 271/107 |
| 49206 | 6/1992 | Japan | 271/10.03 |
| 49308 | 8/1993 | Japan | 271/107 |
| 49405 | 6/1994 | Japan | 271/107 |

*Primary Examiner*—William E. Terrell
*Assistant Examiner*—T. Kelly
*Attorney, Agent, or Firm*—Leydig, Voit & Mayer, Ltd.

[57] ABSTRACT

The invention relates to a sheet feeder unit with a suction head unit whereby sheets are removed individually from a sheet pile, fed to a belt table, and conveyed by the belt table to a sheet-processing machine. The suction head unit and the belt table are driven in phase with the sheet processing machine. Further, the belt table is driven in a periodic manner so that the transfer of sheets from the suction head unit to the belt table occurs at the slowest conveying speed of the belt table. The actual time of reaching the transfer position to the sheet-processing machine is recorded by the respectively foremost sheet located on the belt table and is compared with a reference time. Furthermore, the operating cycle of the suction head unit is corrected to be advanced or retarded in accordance with the deviation of the reference time from the actual time.

14 Claims, 5 Drawing Sheets

SHEET FEEDER UNIT

FIELD OF THE INVENTION

The invention relates to a control system for a printing machine, and more particularly, to the control of the sheet feeder unit of the printing machine.

BACKGROUND OF THE INVENTION

Sheet feeder units are used in conjunction with suction head units in order to control the flow of sheets through a printing machine. Normally, sheets are removed individually from a sheet pile and fed to a belt table. The sheets are then conveyed by the belt table to a sheet-processing machine.

In known sheet feeder units of this type, as disclosed in the German Patent, DE 41 40 051 A1, the suction head unit and the belt table are driven in phase with the sheet-processing machine. Through this means, the flow of sheets through the printing machine may be better controlled so that the sheets are always transferred to the sheet-processing machine at precisely the right time.

Problems in sheet feeders units stem from processing different types of sheets. Depending on the quality and surface finish of the sheets, a varying slip can occur between the sheets and the transporting belts of the belt table. The result is that the sheets are not transferred to the sheet-processing machine at the right time (i.e. the actual time of the sheet transfer deviates from the reference time).

Further, problems in sheet feeders stem from disruption when the sheet is transferred to the belt table. Disruption occurs when the transferred sheet strikes at high speed the front lays of the belt table which define the transfer position. The transferred sheet then bounces back away from the belt table. If the sheet does bounce back upon impact with the belt table, the sheet is no longer being fed to the sheet-processing machine in a precisely positioned manner, causing errors in the sheet feeding.

SUMMARY OF THE INVENTION

It is a general object of the invention to provide a sheet feeder unit which can reliably transfer sheets to the sheet-processing machine at the proper time.

It is a related object of the invention to provide a sheet feeder unit which can adjust the flow of sheets to the sheet-processing machine based on the quality and surface finish of the sheets.

It is a further related object of the invention to minimize the sheet bouncing effect when the sheet is placed onto and removed from the belt table.

The present invention accomplishes these objectives and overcomes the drawbacks of the prior art by providing for a sheet feeder unit of a printing machine which more effectively controls the flow of sheets through the feeder unit. To control the flow of sheets, the actual time of a sheet in reaching the transfer position to the sheet-processing machine is compared with a reference time. Based on the deviation of the reference time from the actual time, the operating cycle of the suction head unit is corrected. The sheets are transferred to the belt table by the suction head unit at an earlier or later time, depending on the deviation from the reference time. By this means, the sheet feeder unit can correct the deviations from the actual time to the reference time. By changing the operation of the suction head unit, the correction takes place in the fastest possible manner without influencing the cycle synchrony of the belt table and the sheet-processing machine. This is due to the fact that the corrective balancing takes place at the beginning of the transport path of the sheets.

Sensors may be used to record the actual time of reaching the transfer position. The sensors record the time based on the leading edge of the foremost sheet when the sheet reaches the transfer position. In order to be able to record precisely when the sheets reach the transfer position, even in the case of large-format sheets, a plurality of sensors can be distributed over the entire sheet width. With this arrangement, the actual time may be calculated regardless of the alignment of the sheet. For example, if the leading edge of the sheet is not aligned precisely, the mean switching time of the sensors may form the actual transfer time of the sheet.

If the sensors are optical sensors, recording of the sheets takes place without contact and thus without impairing the position of the sheets. Further, using light reflecting sensors simplifies construction and saves construction space.

The design of the belt table must minimize disruption when the sheet is transferred to the belt table at high speed. To minimize this effect, the movement pattern of the belt table during an operating cycle can be approximately sinusoidal. The transfer of the sheets to the belt table by the suction head unit takes place approximately at the time of the slowest conveying speed of the belt table. This minimizes the bounce back effect of the transferred sheets since the belt table is at or nearly at a standstill. The sheets can be transferred with high precision so that the sheets also arrive at the transfer position to the sheet-processing machine with high precision of their position.

For the suction head unit, the focus of the control of the sheets relates to when suction head unit transfers the sheets to the belt table. Corrections are made based on changing the transfer time from the suction head unit to the belt table. The corrections of the suction head unit must be made independently of the belt table; therefore, the suction head unit and the belt table advantageously have separate drives.

Automatic correction of the transfer time from the suction head unit can be achieved simply by transferring the signal of the sensors and a cycle signal of the belt table to a control system. The control system can determine whether the actual time deviates in a positive or negative manner from the reference time. Based on this deviation, the control system sends a corresponding correction signal for advancing or retarding the operating cycle to the drive of the suction head. Note that it is also possible for the drive of the suction head to be manually adjustable to be advanced or retarded.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
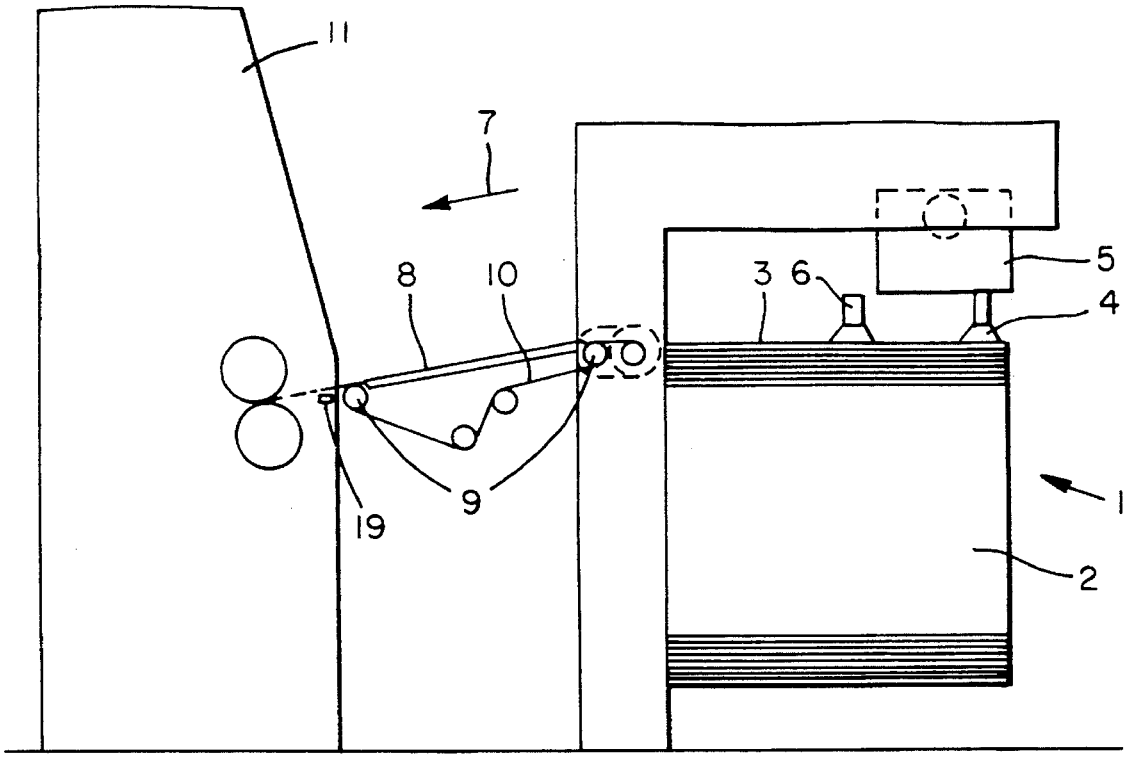
FIG. 1 is a side view of a sheet feeder unit.

The sheet feeder unit illustrated in FIG. 1 has a pile board 1 on which a sheet pile 2 is supported. The respectively uppermost sheet 3 of the sheet pile 2 is lifted from the sheet pile 2 by pick-up suckers 4 of a suction head unit 5, transferred to forwarding suckers 6 of the suction head unit 5 and fed by the latter in the conveying direction 7 to a receiving end of a belt table 8.

In the conveying direction 7, the belt table 8 has, at its receiving end and at its transfer end, rollers 9 which can be driven in rotation, extend transversely to the conveying direction 7, and around which a plurality of transporting belts 10 are guided adjacently, which can be designed as suction belts. Following the belt table in the conveying direction 7 is a sheet-processing machine 11 which, in the present exemplary embodiment, is a printing machine.

Figure 2:
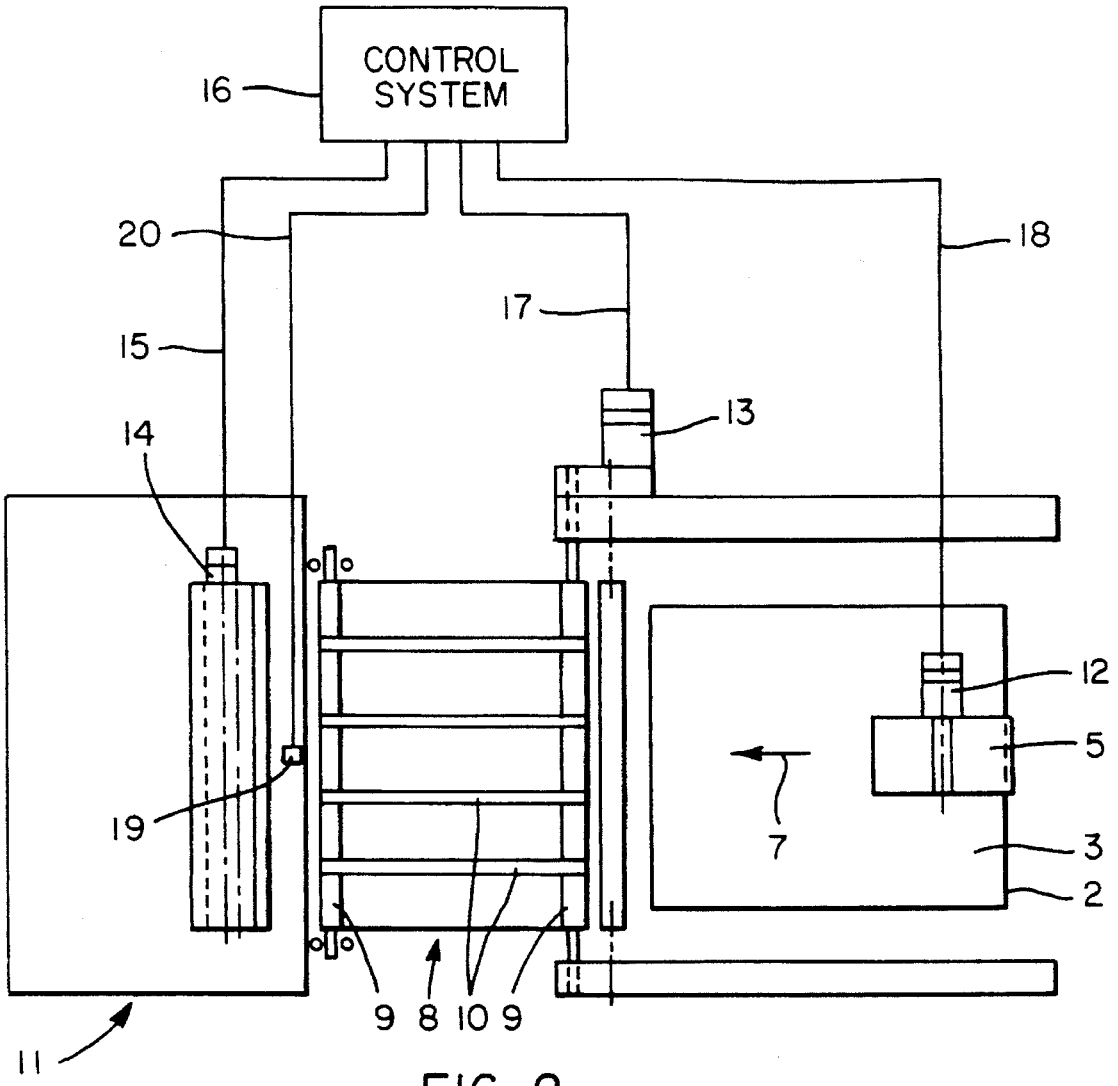
FIG. 2 is a plan view of the sheet feeder unit according to FIG. 1.

As shown in FIG. 2, the suction head unit 5, the belt table 8 and the sheet-processing machine 11 each have their own drives. The suction head unit 5 has the suction head drive 12, the belt table 8 has the belt drive 13, and the sheet-processing machine 11 has the sheet-processing drive 14. The control system 16 ensures the proper synchronization of each of the three drives.

The control system 16 includes a synchronizer 29 that performs two functions in order to ensure the proper operation of the three drives. First, the synchronizer 29 matches the operating cycle of the sheet-processing drive 14 with the belt drive 13 and the suction head drive 12. A synchronizing signal is fed by the sheet-processing drive 14 via a sheet-processing line 15 to the synchronizer 29 which is shown in detail in FIG. 4. The synchronizer 29 sends the synchronizing signal via a belt line 17 to the belt drive 13.

Figure 4:
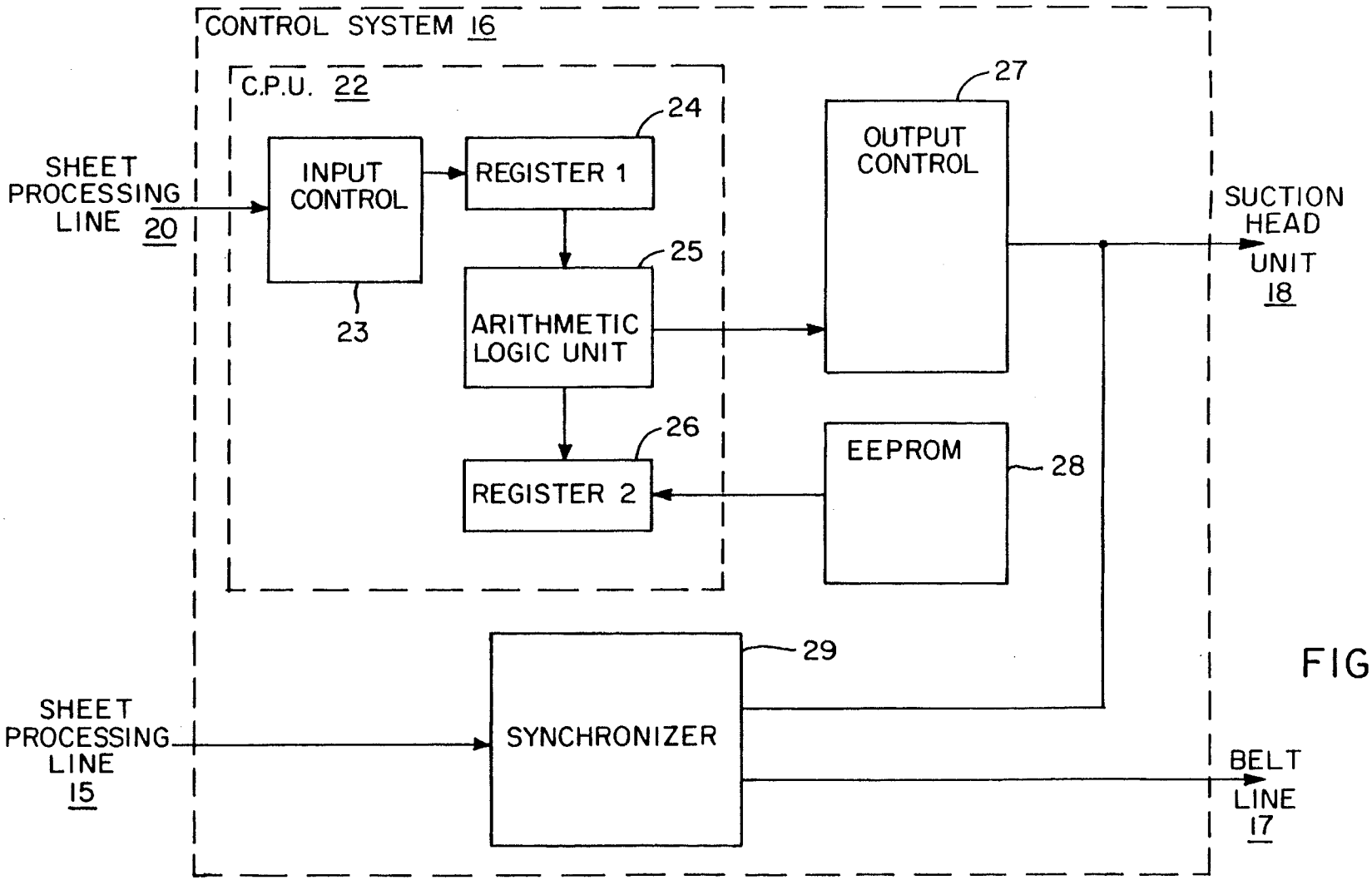
FIG. 4 is a block diagram of the control system.

Further, the operating cycles of the belt drive 13 and the suction head drive 12 are correspondingly actuated by the control system 16. As shown in FIG. 4, the synchronizer 29 sends a signal to the suction head unit 5 via a suction head line 18 to match the operating cycles. Therefore, the frequency of operation or operating cycle of the suction head unit 5 and the belt table 8 are the same.

Figure 3:
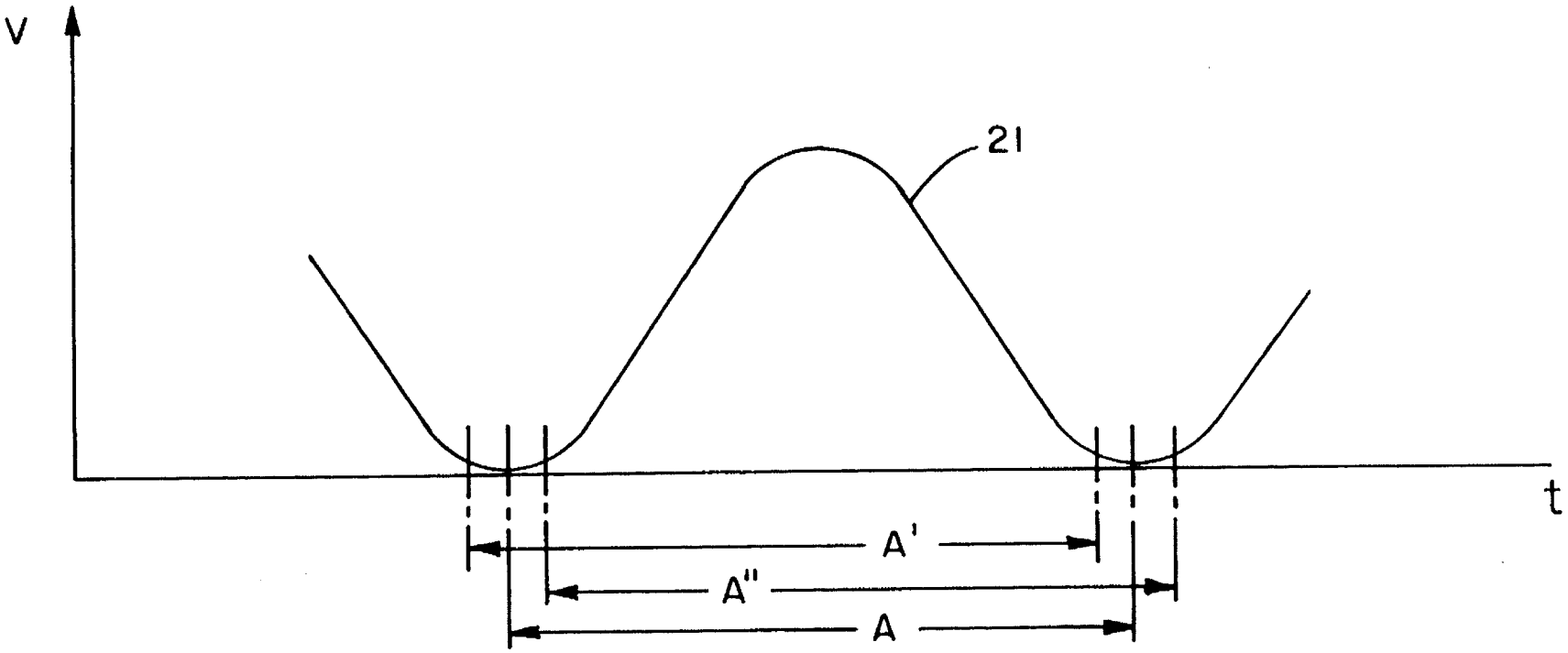
FIG. 3 is a diagram of the speed of the transporting belts over the time of the belt table of the sheet feeder according to FIG. 1.

Second, the synchronizer 29 drives the belt drive 13 in a sinusoidal manner in order to minimize sheet disruption upon transferring the sheets to the belt table 8. As can be seen in FIG. 3, the belt table 8 is driven in such a way that, during an operating cycle "A", the transporting belts 10 are accelerated from a slow conveying speed and are decelerated again to the slow conveying speed towards the end of the operating cycle. As a result, the movement pattern of the transporting belts 10 of the belt table 8 is approximately sinusoidal. Both the transfer of the sheets by the suction head unit 5 to the belt table 8 and the transfer of the sheets from the belt table 8 to the sheet-processing machine 11 ideally take place at the time of the slowest conveying speed of the belt table 8. Thus, the sheet bouncing due to a moving belt table 8 is minimized.

Both the functions of the synchronizer 29 may be performed internally within the belt table 8. The sheet-processing machine 11 can be directly connected to the belt table 8 whereby a microprocesssor within the belt table 8 performs the synchronization of the belt drive 13 with the sheet-processing drive 14. Also, the sinusoidal motion of the belt drive can be performed by a microprocessor within the belt table 8.

Owing to the different surface finish in the case of sheets of different quality or different materials, for example, slip can occur between the sheet and the units transporting it on the transport path from the suction head unit 5 up to transfer to the sheet-processing machine 11. The sheet then reaches the transfer position to the sheet-processing machine 11 at a later time than is required for its operating cycle. In order to avoid this, the transfer position to the sheet-processing machine 11 being reached is recorded by an optical sensor 19 (FIG. 2) and a corresponding signal is passed on to the control system 16 via a sheet processing line 20 as best seen in FIG. 4. In this case, the optical sensor 19 can be located in the region of the transfer position below the transporting plane of the sheet and can emit the signal when the leading edge of the sheet reaches the transfer position.

If the actual time of the transfer position to the sheet-processing machine 11 being reached deviates from the reference time prescribed by the operating cycle of the sheet-processing machine 11, this is recognized by the control system 16. The control system 16, as shown in FIG. 4, contains a central processing unit (CPU) 22, an EEPROM 28, an input control 23, and an output control 27. The input control 23 receives the input from the optical sensor 19 via the sheet processing line 20, determines the actual time of the transfer of the sheet to the transfer position, and places the value into register 24. The reference value for the time of a sheet to the transfer position is accessed from the EEPROM 28 and placed into registers 26. As an alternative to the EEPROM 28, the reference value may be manually input into register226. The values in the two registers 24 and 26 are sent to an arithmetic logic unit 25 where the difference in the register values are determined. Depending on the value of the difference which is sent to the suction head line 18 via the output control 27, the suction head drive 12 of the suction head unit 5 is correspondingly actuated to be advanced or retarded in its operating cycle.

For example, in the case of the transfer position being reached with retardation (the actual time is greater than the reference time), this being established by the arithmetic logic unit 25 via the optical sensor 19, the sheets are then fed to the belt table 8 by the suction head unit 5 with a corresponding advance. The sheets then reach the transfer position to the sheet-processing machine exactly in phase. In the case of the transfer position being reached in advance, (i.e. the actual time is less than the reference time, as determined by the arithmetic logic unit 25), the sheets are then fed to the belt table 8 by the suction head unit 5 with a corresponding retardation. The sheets then reach the transfer position to the sheet-processing machine exactly in phase.

Thus, depending on the deviation between the suction head unit 5 and the belt table 8, the control system 16 modifies the phase of periodic function driving the suction head drive 12. The frequency, or operating cycle of the suction head unit 5, is not modified. But, the phase of the suction head unit is shifted based on whether the sheets reach the transfer position in retardation or in advance. After the phase shift of the suction head unit 5, the sheets arrive at the sheet processing machine 11 in the proper phase by correcting for the slip caused by the sheets.

Whereas in FIG. 3 the invariable movement pattern of the transporting belts 10 is illustrated by the curve 21, the operating cycle of the suction head unit 5 is denoted by "A". If, by corresponding actuation, an advance of the operating cycle of the suction head unit 5 is achieved, this operating cycle takes place during the period denoted by "A'"; in the case of retardation during the period denoted by "A"".

As can be seen from the curve 21 of the movement pattern of the transporting belts, even in the case of an advance or retardation of the transfer of the sheets by the suction head unit 5, the speed level of the suction belts is, to a great extent, equally low, such that a precise transfer of the sheets by the suction head unit 5 always takes place.

Figure 5:
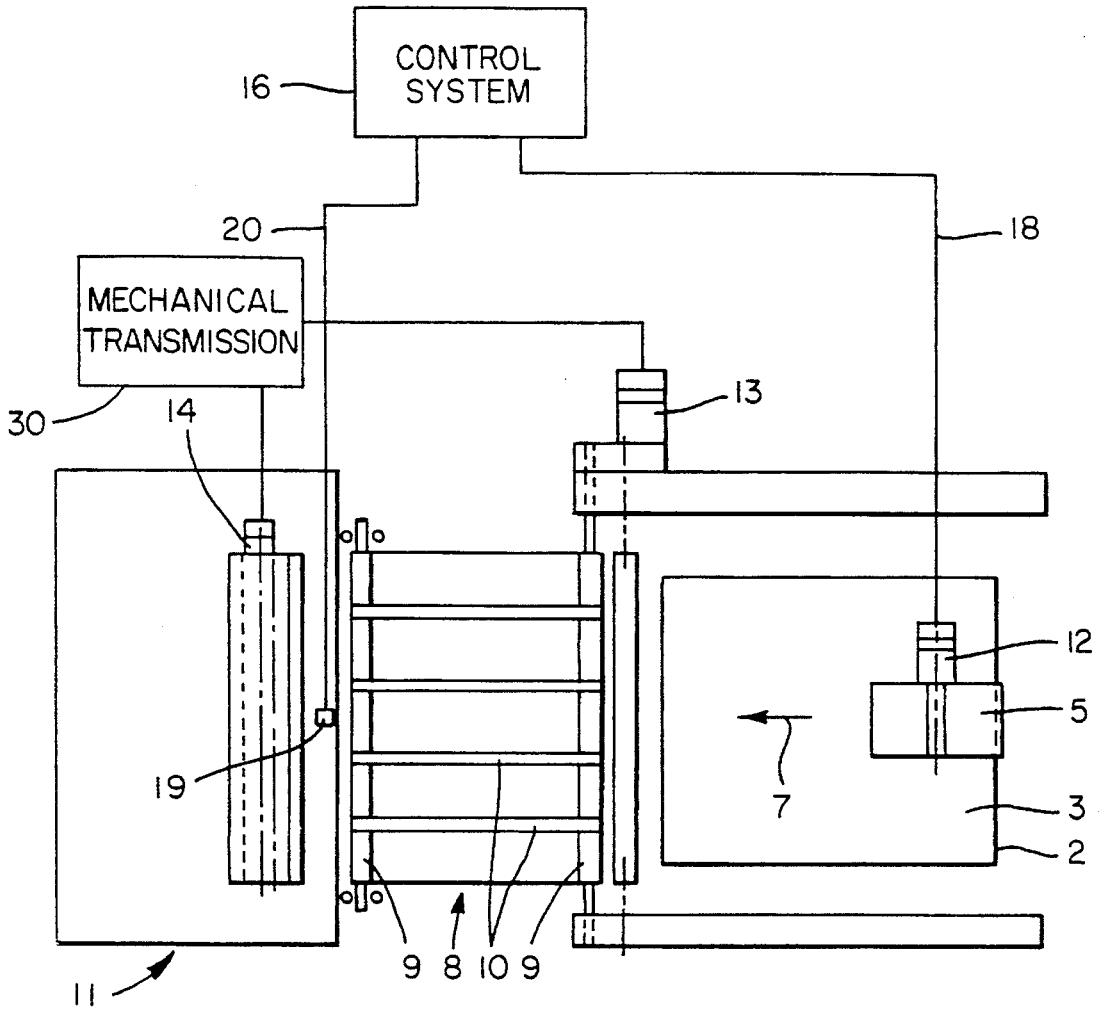
FIG. 5 is an alternative view of the sheet feeder unit.

In the present exemplary embodiment, the sheet-processing machine 11 and the belt table 8 have their own drives, the control system 16 ensuring synchronous running. It is obvious that such synchronous running can also be achieved if the drive of the belt table takes place by means of the drive of the sheet-processing machine 11. As shown in FIG. 5, the drive of the belt table 8 can be mechanically coupled with the sheet-processing drive 14 by a mechanical transmission 30 of conventional design which produces a sinusoidal movement from a continuous movement.

What is claimed is:

1. A sheet feeder unit for controlling the movement of sheets through a printing machine comprising in combination a suction head unit with a suction head drive for removing sheets from a stack; a belt table with a belt drive for receiving sheets from the suction head unit, the suction head drive being independently changeable from the operation of the belt drive; a control system which drives the belt drive in a periodic manner and synchronizes the transfer of sheets from the suction head unit to the belt table to occur approximately at a time of slowest conveying speed of the belt drive, the control system including (1) means for providing input signals indicating time of the transfer of the sheets, and (2) a controller for comparing values of the input signals with a reference value and in response to the comparison controlling the operation of the suction head drive independently of the belt drive to correct the deviation between the input signal and the reference value.

2. Sheet feeder unit as defined in claim 1 wherein the periodic manner is a sinusoid.

3. Sheet feeder unit as defined in claim 1 wherein the slowest conveying speed of the belt table is approximately zero.

4. Sheet feeder unit as defined in claim 1 wherein the input means comprises at least one sensor.

5. Sheet feeder unit as defined in claim 4 wherein leading edge of the foremost sheet reaching a transfer position can be recorded by the sensor.

6. Sheet feeder unit as defined in claim 4 wherein the sensor is an optical sensor.

7. Sheet feeder unit as defined in claim 6 wherein the optical sensor is a light reflecting sensor.

8. Sheet feeder unit as defined in claim 4 wherein a plurality of sensors is distributed over the sheet width.

9. Sheet feeder unit as defined in claim 1 wherein the reference value is received from a memory device.

10. Sheet feeder unit as defined in claim 1 wherein the reference value is received from manual input.

11. Sheet feeder unit as defined in claim 1 wherein the controller calculates the difference between the input signal and the reference value.

12. Sheet feeder unit as defined in claim 1 wherein the control signals advance or retard the operating cycle to correct the deviation.

13. Sheet feeder unit as defined in claim 1 wherein each of the belt drive, suction head and printing machine has separate drives.

14. A sheet feeder unit for controlling the movement of sheets through a printing machine and a print drive comprising in combination a suction head unit with a suction head drive for removing sheets from a stack; a belt table with a belt drive for receiving sheets from the suction head unit where the print drive is mechanically coupled to the belt drive to produce a periodic movement in the belt drive, and the suction head drive is independently changeable from the operation of the belt drive; a control system which synchronizes the transfer of sheets from the suction head unit to the belt table to occur approximately at a time of slowest conveying speed of the belt drive, the control system including (1) means for providing input signals indicating time of the transfer of the sheets, (2) means to synchronize movement of the suction head unit and belt table so that the said unit and table are driven in phase and (3) a controller for comparing values of the input signals with a reference value, and in response to the comparison controlling the operation of the suction head drive independently of the belt drive to correct the deviation between the input signal and the reference value.

* * * * *